United States Patent [19]

Stout et al.

[11] Patent Number: 5,050,265

[45] Date of Patent: Sep. 24, 1991

[54] SWIVEL BOWL WEAR INSERT FOR DEBRIS INTAKE APPARATUS

[76] Inventors: Claude E. Stout; Claude R. Stout, both of 2 Chaffee La., Southington, Conn. 06489

[21] Appl. No.: 628,507

[22] Filed: Dec. 10, 1990

[51] Int. Cl.[5] ..... A47L 9/00; E01H 1/08

[52] U.S. Cl. ..... 15/340.1; 15/414

[58] Field of Search ..... 15/340.1, 347, 414, 15/340.3, 340.4

[56] References Cited

U.S. PATENT DOCUMENTS

| | | | |
|---|---|---|---|
| 2,878,508 | 3/1959 | Sedgwick et al. | 15/340.1 X |
| 3,193,867 | 7/1965 | Daneman et al. | 15/340.1 X |
| 3,444,581 | 5/1969 | Daneman | 15/414 X |
| 3,819,069 | 6/1974 | Bauman et al. | 15/340.1 X |
| 3,995,754 | 12/1976 | DeKoning | 15/340.1 X |
| 4,200,950 | 5/1980 | Coverly | 15/340.1 X |

*Primary Examiner*—Chris K. Moore

[57] ABSTRACT

A wear insert for a plate adapter of a swivel bowl apparatus which is a vital part of a debris intake hose system. Such system utilizes a high vacuum by means of a high pressure blower. Under a high vacuum, sand and other abrasive properties cause severe wear to the plate adapter wall due to the rocking action of the swivel bowl. Such wear eventually render the system inoperable. The wear insert restores immediate operability of the system without repair or replacement to the plate adapter.

3 Claims, 2 Drawing Sheets

SWIVEL BOWL WEAR INSERT FOR DEBRIS INTAKE APPARATUS

FIELD OF THE INVENTION

This invention relates to mobile apparatus for sucking up and removing trash and litter from streets and highways by means of a large flexible hose under high vacuum. Use of such apparatus is well known and one type is shown in U.S. Pat. No. 3,052,908, issued Sept. 11, 1962 to inventor Ben Danerman. The apparatus of the patent has a flexible hose which can be selectively connected to openings in the sides or rear of an enclosed vacuum tank mounted on a truck chassis. The hose is manually manipulated back and forth across the edge of the street or gutter by an operator standing on the street alongside or behind the tank. The operator manually directs the intake end of the hose to the debris to be sucked into the tank. The opposite end of the hose is connected to an input orifice of the tank by means of a swivel bowl positioned within a plate adapter that is secured to the outer wall of the tank. The swivel action of the bowl permits facile manual manipulation of the intake end of the hose back and forth across the edge of the roadway or gutter to suck in the debris.

SUMMARY OF THE INVENTION

The present invention relates to the swivel bowl apparatus and particularly to the plate adapter in which the bowl swivels. An intake system, as set out above, when in use for debris, litter, sewer cleaning or leaf pick-up sand and/or other abrasive properties, in conjunction with the swivel bowl action, causing severe wear to the inner wall of the plate adapter. Large and small openings worn through the inner wall of the plate adapter cause loss of suction, render the debris removing apparatus inefficient and eventually inoperable. The novel wear insert of this invention restores efficient operability to the system without undue delay at relatively little expense.

DETAILED DESCRIPTION OF THE INVENTION

Figure 1:
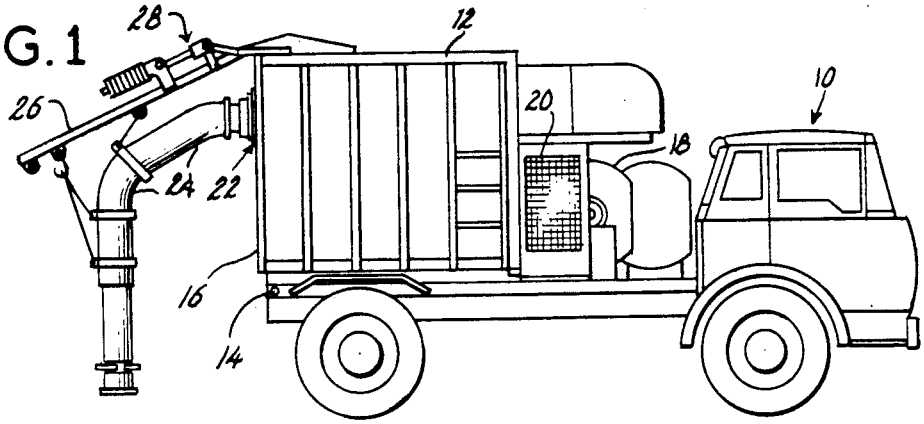
FIG. 1 is a side view of a mobile street cleaning apparatus diagrammatically illustrating the intake hose apparatus used in connection with this invention.

With reference to the drawing, and particularly FIG. 1, the debris-collecting apparatus illustrated is mounted on an engine-driven truck 10 which is equipped with a fully enclosed tank 12 suitably secured to the frame of the vehicle. Tank 12 is pivotally mounted as at 14 in order to permit the tank to be tipped rearwardly and discharge the collected debris. Tank 12 is provided with the well-known rear gate 16 which is hinged and serves as a dumping door. During debris pick-up a high vacuum is maintained in tank 12 by means of a high pressure blower 18, driven through suitable belts or the like by an engine 20; the blower being in communication with the interior of tank twelve through a duct (not shown).

A plate adapter 22 is rigidly clamped to rear gate 16 at an intake port in the upper portion of rear gate 16. A corrugated, flexible hose 24 of large diameter is attached to adapter 22 in a manner to be set out later on. However, it is important to here note that the intake end of hose 24 is maniputable to effect debris pick-up while the discharge end of the hose is connected for swivel action. Hose 24 is carried by an arm 26 of a power boom 28, the particulars of which are set out in the above-referred to U.S. Pat. No. 3,052,908.

Figure 2:
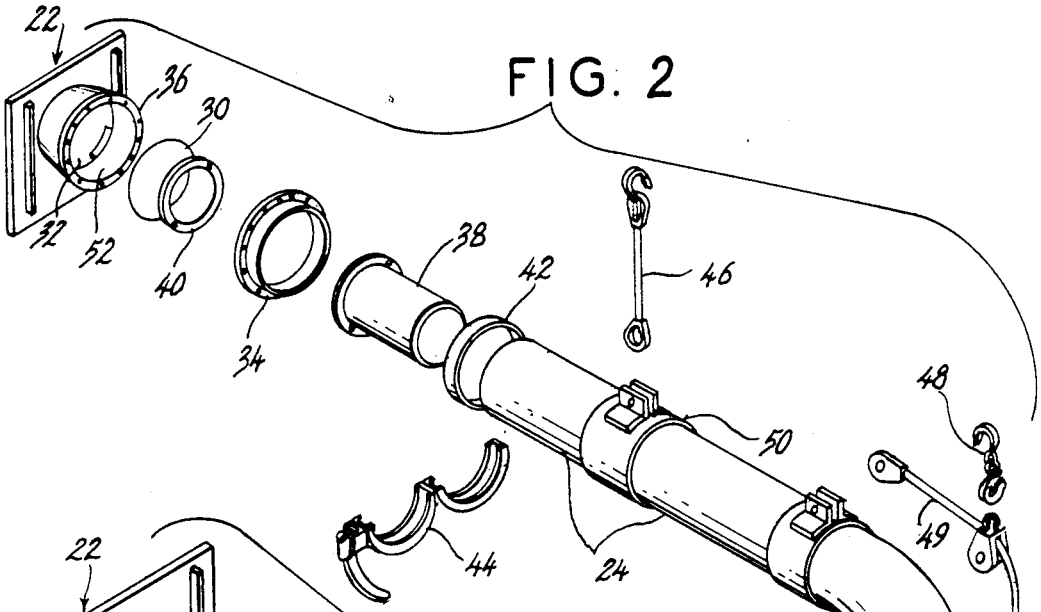
FIG. 2 is an exploded view of the intake hose apparatus of FIG. 1.

With reference more particularly to FIG. 2, a swivel bowl 30 is arranged for swivelling in a radial and tapered mouth 32 of plate adapter 22. A retaining ring 34 fits over swivel bowl 30 and is bolted to a flange 36 of plate adapter 22 and thereby forms a sub-assembly of the debris intake apparatus.

A hose coupling 38 is bolted to a flange 40 of the swivel bowl and the upper, forward end of hose 24 is received on the hose coupling 38 and secured by a squeeze band 42 and a clamp 44, chain boom 48 and cable boom 49 are attached to support collars 50 for hose manipulation in a well known manner.

Figure 3:
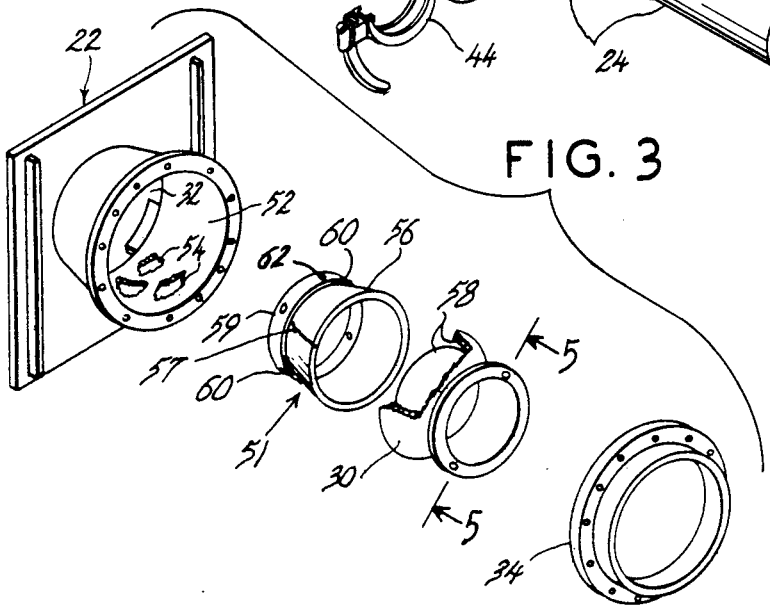
FIG. 3 is an exploded view illustrating the swivel bowl apparatus of FIG. 2 on a slightly larger scale and adding the wear insert of the invention.
Figure 4:
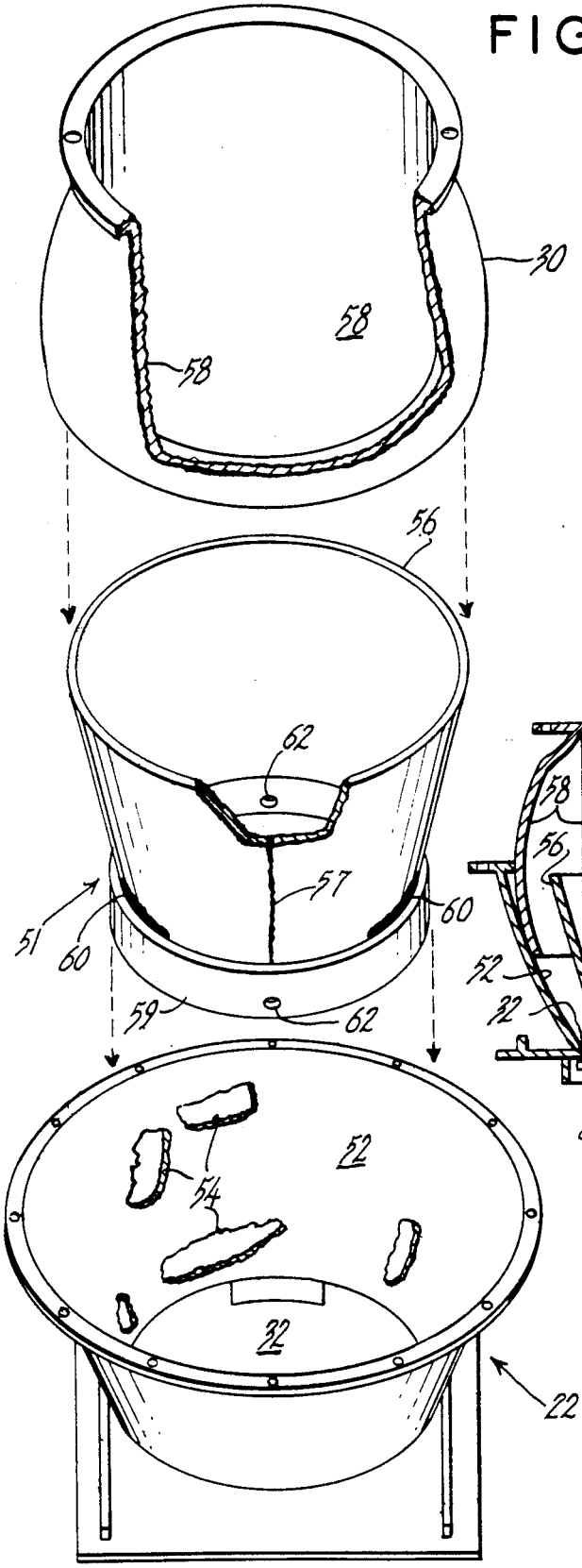
FIG. 4 is an exploded view illustrating the the mounting relationship of the wear insert and swivel bowl with damaged plate adapter.
Figure 5:
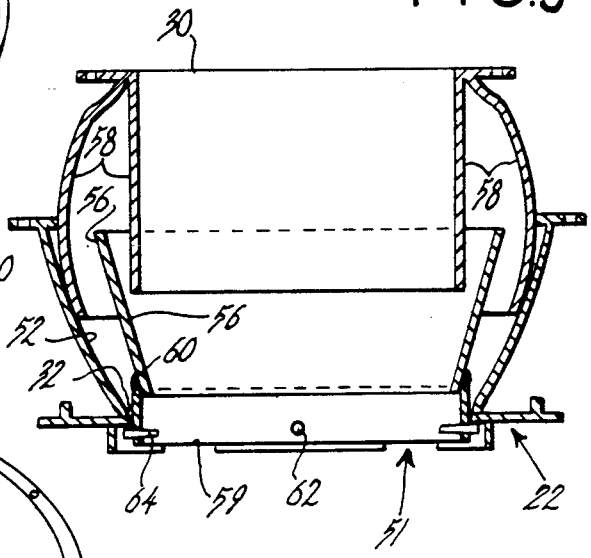
FIG. 5 is a sectional view of the pertinent FIG. 4 units as assembled for operational use; taken substantially along lines 5—5 of FIG. 3.

With particular reference to FIGS. 3, 4 and 5, the plate adapter-swivel bowl-retaining ring sub-assembly is illustrated at a larger scale, and it is important to note that a wear insert 51 of the invention has been added. The apparatus previously described has been know in the debris pick-up field for many years but set out here for a fuller understanding of the invention.

Accordingly, following a relatively short period of use, the inner wall 52 of plate adapter 22 is severely damaged as a result of debris pick-up caused by the intake sand, pebbles, rocks and abrasive properties which are picked up under high vacuum, plus the rocking action of swivel bowl 30, as indicated at 54. Such damage results in a considerable loss of vacuum, inefficient operation and eventually renders the system inoperative as sand or other debris are undesirably captured in openings 54. Prior to the present invention, extensive repair by welding and rebuilding inner wall 52 of plate adapter 22 was necessary while the debris pickup apparatus lay idle for an extended period of time.

In accordance with the invention, the body section 56 of wear insert 51 is preferably of 3/16 inch hot rolled steel and is formed as shown from a crescent-life sheet of appropriate length and width. Such sheet is rolled in tapered fashion by a suitable fixture such as a set of pressure rollers and guide rollers. The formed body section is removed from the rollers and placed in a fixture for welding, as at 57. Thereby, the upper circumference of the insert may be accommodated between the inner walls 58 of swivel bowl 30, as best seen as in FIG. 5. To complete the insert, a ring 59 is welded to the body section 56, as at 60. It should here be noted that, alternatively, the wear insert 51 might be fabricated of one piece by virtue of proper tooling. Bores 62 are provided in ring 59 to accommodate tapered or expansion pins 64, the ends of which are driven through bores 62 and beneath the bottom of plate adapter 22 to thereby rigidly hold the wear insert in the position shown in FIG. 5.

In operation, to effect repair to the debris collecting apparatus, the plate adapter-swivel bowl-retaining ring assembly is dismantled. Ring 59 of wear insert 51 is then inserted into the mouth 32 of plate adapter 22 and retained by a set of four pins 64. Swivel bowl 30 is then set into plate adapter 22 and astride the body section 56 of the insert. The sub-assembly is put together with the inclusion of wear insert 51 and the system restored to efficient operation. Debris is now diverted through wear insert 51 and wall 52 of plate adapter 22 is bypassed. The swivel bowl may now rock freely within plate adapter 22 during hose manipulation for debris pick-up and further damage to wall 52 of the plate adapter is avoided.

By virtue of the present invention, the wear insert avoids expensive repair while effecting a quick and reliable fix to the debris pick-up system. The wear insert of this invention has, in fact, gone into commercial use and has proven to be highly satisfactory as it is far less expensive to adapt the illustrated wear insert than to repair or replace the plate adapter.

Having described the invention, we claim:

1. A vacuum debris collector comprising, a vehicle movable over the area to be cleared, an enclosed vacuum tank on the vehicle having an intake opening, a flexible pick-up hose having a debris intake end and a debris discharge end, the debris discharge end of the pick-up hose directed into the vacuum tank intake opening, a swivel bowl having inner and outer walls, the swivel bowl connected to the hose, a plate adapter having an inner wall to receive the swivel bowl for swivel action, and a wear insert for placement between the inner and outer walls of the swivel bowl, the wear insert secured to the plate adapter to serve to divert the collected debris away from the inner wall of the plate adapter and into the intake opening of the vacuum tank.

2. The apparatus of claim 1 wherein the wear insert includes a body portion and a ring portion formed together, the ring portion having means therein to permit the wear insert to be secured to the plate adapter and thereby facilitate diversion of debris away from the inner wall of the plate adapter and into the intake opening of the vacuum tank.

3. The apparatus of claim 2 wherein the wear insert body portion is tapered outwardly, the tapered body portion serving to direct the collected debris into the intake opening of the vacuum tank.

* * * * *